US009436196B2

(12) United States Patent
Chan

(10) Patent No.: US 9,436,196 B2
(45) Date of Patent: Sep. 6, 2016

(54) VOLTAGE REGULATOR AND METHOD

(71) Applicant: TAIWAN SEMICONDUCTOR MANUFACTURING COMPANY, LTD., Hsinchu (TW)

(72) Inventor: Hao-Chieh Chan, Hsinchu (TW)

(73) Assignee: TAIWAN SEMICONDUCTOR MANUFACTURING COMPANY, LTD. (TW)

( * ) Notice: Subject to any disclaimer, the term of this patent is extended or adjusted under 35 U.S.C. 154(b) by 0 days.

(21) Appl. No.: 14/464,214

(22) Filed: Aug. 20, 2014

(65) Prior Publication Data

US 2016/0056798 A1 Feb. 25, 2016

(51) Int. Cl.

| | |
|---|---|
| ***G05F 1/56*** | (2006.01) |
| ***G05F 1/618*** | (2006.01) |
| ***G05F 1/613*** | (2006.01) |

(52) U.S. Cl.

CPC ..... *G05F 1/56* (2013.01); *G05F 1/613* (2013.01); *G05F 1/618* (2013.01)

(58) Field of Classification Search

CPC ..... G05F 1/56; G05F 1/562; G05F 1/565; G05F 1/613; G05F 1/615; G05F 1/618

See application file for complete search history.

(56) References Cited

U.S. PATENT DOCUMENTS 4,833,342 A * 5/1989 Kiryu et al. ..... 327/541
5,302,888 A * 4/1994 Hellums ..... G05F 3/24 323/280
6,333,623 B1 * 12/2001 Heisley ..... G05F 1/575 323/224
6,700,361 B2 * 3/2004 Gregorius ..... 323/282
7,285,942 B2 * 10/2007 Man et al. ..... 323/274
7,629,711 B2 * 12/2009 Zhong et al. ..... 307/103
7,737,676 B2 * 6/2010 Kimura ..... 323/315
8,044,653 B2 * 10/2011 Maige ..... G05F 1/575 323/313
8,253,479 B2 * 8/2012 Haddad et al. ..... 327/540
8,305,059 B2 * 11/2012 Al-Shyoukh ..... 323/282
8,378,652 B2 * 2/2013 Xie ..... 323/274
8,558,530 B2 * 10/2013 Pulijala ..... G05F 1/56 323/314
8,619,401 B2 * 12/2013 Singnurkar ..... 361/93.1
8,648,580 B2 * 2/2014 Wong ..... G05F 1/575 323/265
8,674,672 B1 * 3/2014 Johal ..... G05F 1/565 323/275
9,229,462 B2 * 1/2016 Shukla ..... G05F 1/56
9,240,762 B2 * 1/2016 Kronmueller ..... H03F 3/04
2015/0212530 A1 * 7/2015 Forejtek ..... G05F 1/56
2015/0355653 A1 * 12/2015 Drebinger ..... G05F 1/575 323/280

* cited by examiner

*Primary Examiner* — Thomas J Hiltunen
(74) *Attorney, Agent, or Firm* — Hauptman Ham, LLP

(57) ABSTRACT

A device includes a voltage buffer, a load compensation circuit, and a closed-loop current feedback circuit. The voltage buffer is configured to output an output voltage and an output current. The output current is the sum of a load current and a bias current. The load compensation circuit is configured to output the bias current at a variable level based on a variation in the load current. The closed-loop current feedback circuit is configured to feedback a voltage level based on the variation to the load compensation circuit.

20 Claims, 4 Drawing Sheets

VOLTAGE REGULATOR AND METHOD

BACKGROUND

The semiconductor industry has experienced rapid growth due to improvements in the integration density of a variety of electronic components (e.g., transistors, diodes, resistors, capacitors, etc.). For the most part, this improvement in integration density has come from a shrinkage in physical size of a semiconductor process node (e.g., a reduction in the size of the process node toward that of a sub-20 nanometer (nm) node).

Shrinking the semiconductor process node involves a reduction in operating voltage and current consumption of electronic circuits developed in the semiconductor process node. For example, operating voltages have dropped from 5V to 3.3V, 2.5V, 1.8V, and even 0.9V. A wave of mobile device popularity has increased pressure in the industry to develop low power circuits that only drain a tiny operating current from batteries that power the mobile devices. Lower operating current extends battery life of battery-operated mobile devices, such as smartphones, tablet computers, ultrabooks, and the like.

Voltage regulators are circuits that output an ideally constant voltage over a large range of current loads. Many voltage regulators employ negative feedback that senses the current load, and compensates for changes in the current load to maintain a steady output voltage. Typically, a tradeoff exists between output voltage stability and speed in voltage regulator circuits.

BRIEF DESCRIPTION OF THE DRAWINGS

For a more complete understanding of the present embodiments, and the advantages thereof, reference is now made to the following descriptions taken in conjunction with the accompanying drawings, in which.

DETAILED DESCRIPTION OF ILLUSTRATIVE EMBODIMENTS

The making and using of the present embodiments are discussed in detail below. It should be appreciated, however, that the present disclosure provides many applicable inventive concepts that can be embodied in a wide variety of specific contexts. The specific embodiments discussed are merely illustrative of specific ways to make and use the disclosed subject matter, and do not limit the scope of the different embodiments.

Embodiments will be described with respect to a specific context, namely voltage regulator circuits and related methods. Other embodiments may also be applied, however, to other types of circuits.

Throughout the one or more figures and discussion, like reference numbers refer to like objects or components. Also, although singular components may be depicted throughout some of the figures, this is for simplicity of illustration and ease of discussion. A person having ordinary skill in the art will readily appreciate that such discussion and depiction can be and usually is applicable for many components within a structure.

In the following disclosure, a novel voltage regulator circuit and method are introduced. The voltage regulator circuit uses closed-loop current feedback to achieve fast response time and accurate output voltage over a large range of capacitor/current loads.

Figure 1:
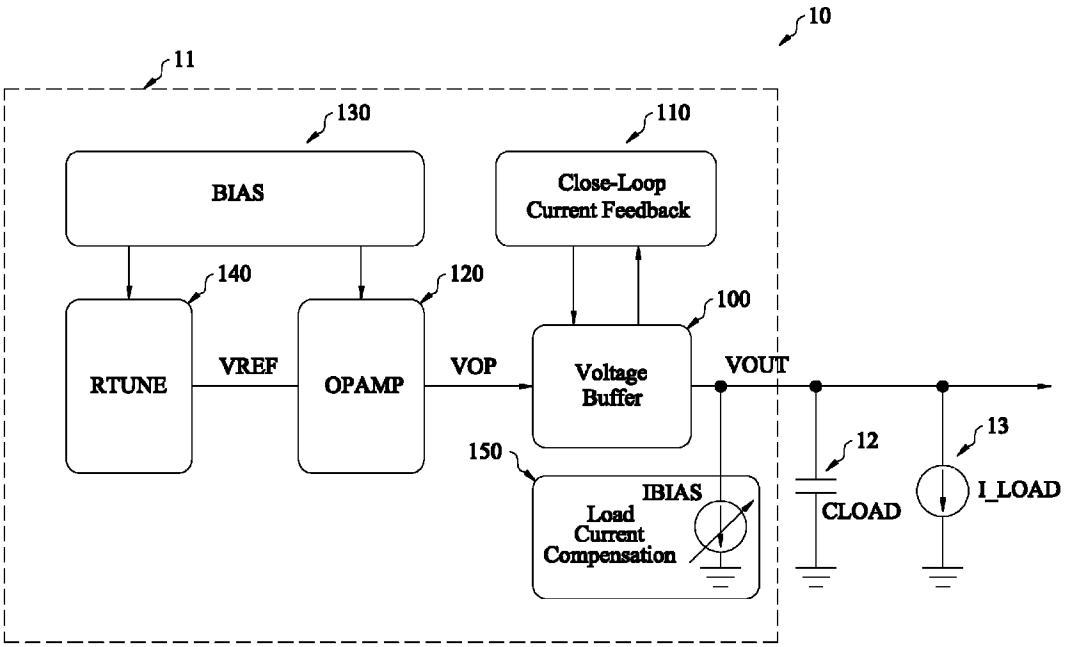
FIG. 1 is a block diagram of an electronic circuit, in accordance with one or more embodiments of the present disclosure.

FIG. 1 is a block diagram of an electronic circuit 10 in accordance with one or more embodiments of the present disclosure. Electronic circuit 10 includes voltage regulator 11. Voltage regulator 11 is electrically connected to an equivalent capacitor 12 and an equivalent current source 13. Voltage regulator 11 provides output voltage VOUT to equivalent capacitor 12 and equivalent current source 13, and is configured to maintain output voltage VOUT at a nominally constant level in the presence of changes in equivalent capacitor 12 and equivalent current source 13. In some embodiments, equivalent capacitor 12 represents a capacitive load electrically connected to voltage regulator 11 generated by one or more electronic circuits electrically coupled with voltage regulator 11. In a non-limiting example, the electronic circuits are analog circuits (e.g., amplifiers, filters, or the like), digital circuits (e.g., registers, flip-flops, logic gates, or the like), or other types of electronic circuits. In some embodiments, equivalent current source 13 represents a current drawn by the electronic circuits electrically coupled with voltage regulator 11. Following the previous example, one or more of the electronic circuits are enabled at any time, and an output of voltage regulator 11 varies with the quantity and power consumption of the electronic circuits that are enabled and/or switched on or off at any time. An example of a worst-case variation in equivalent current source 13 would be if all cells of an array switched at the same time, which would cause a substantial transient, or "spike," in equivalent current source 13. Voltage regulator 11, accordingly, mitigates the effect of the transient on the voltage level of output voltage VOUT.

Output voltage VOUT is generated by amplifier circuit 120 and voltage buffer 100 in response to reference voltage VREF. Reference voltage VREF is generated by resistive divider 140 and bias circuit 130. Closed-loop current feedback circuit 110 and load current compensation circuit 150 stabilize output voltage VOUT. Voltage buffer 100 is electrically coupled with closed-loop current feedback circuit 110. Voltage buffer 100 is electrically coupled with amplifier circuit 120, and receives VOP from amplifier circuit 120. Amplifier circuit 120 is electrically coupled with resistive divider 140, and generates VOP in response to reference voltage VREF. Resistive divider 140 is electrically coupled with bias circuit 130, and generates reference voltage VREF based on biasing conditions established by bias circuit 130. Closed-loop current feedback circuit 110 provides closed-loop current feedback based on operating conditions of voltage buffer 100. Load current compensation circuit 150 is electrically coupled with voltage buffer 100, and generates bias current I_BIAS in a way that varies with load current I_LOAD, such that I_BIAS+I_LOAD (or, "I_TAT") is nominally constant. Keeping output current I_TAT nominally constant aids in response time and stability, improving performance of voltage regulator 11.

Figure 2:
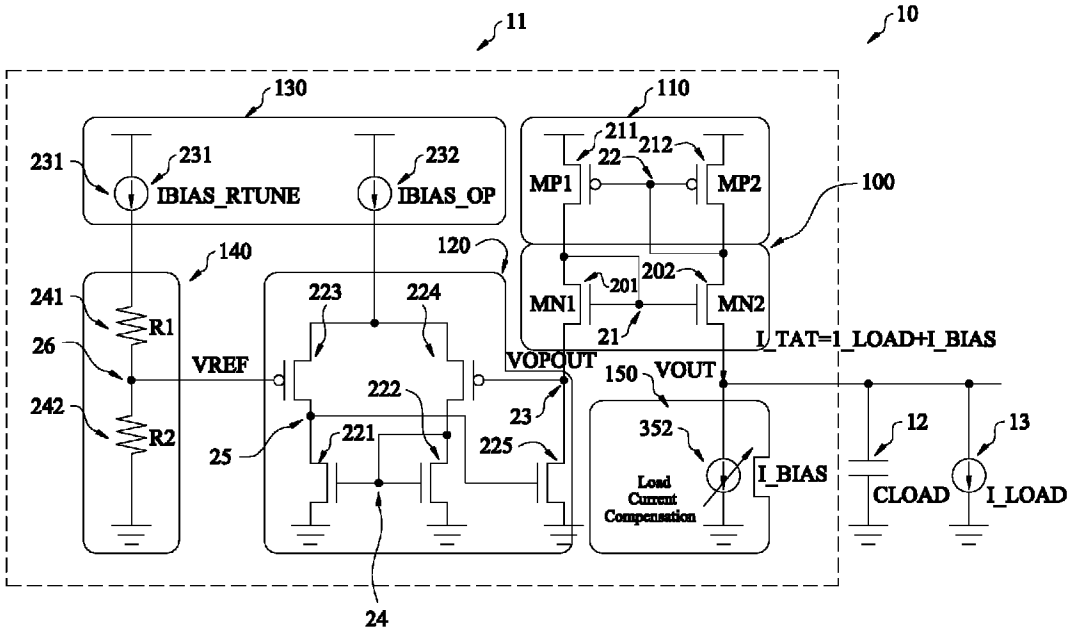
FIG. 2 is a circuit diagram of an electronic circuit, in accordance with one or more embodiments of the present disclosure.

FIG. 2 is a circuit schematic diagram of the voltage regulator voltage regulator 11, in accordance with one or more embodiments of the present disclosure. The voltage regulator 11 is coupled with equivalent capacitor 12 and equivalent current source 13. Bias circuit 130 provides first bias current I_BIAS_RTUNE to resistive divider 140 by first bias current source 231, and second bias current I_BIAS_OP to amplifier circuit 120 by second bias current source 232. In some embodiments, first bias current source 231 is a constant current source, such as a bandgap current reference. In some embodiments, second bias current source 232 is a constant current source, such as a bandgap current reference. A first terminal of first bias current source 231 is electrically coupled with a first voltage supply node. A second terminal of first bias current source 231 is electrically coupled with a first terminal of resistive divider 140. A first terminal of second bias current source 232 is electrically coupled with the first voltage supply node. A second terminal of second bias current source 232 is electrically coupled with a first terminal of amplifier circuit 120.

Resistive divider 140 establishes reference voltage VREF for input to amplifier circuit 120. In some embodiments, resistive divider 140 includes a resistive divider circuit, as shown in FIG. 2. Resistive device 241 of resistive divider 140 has a first terminal electrically coupled with the second terminal of first bias current source 231. Resistive device 241 has a second terminal electrically coupled with a first terminal of resistive device 242 at node 26. A second terminal of resistive device 242 is electrically coupled with a second voltage supply node. In some embodiments, the second voltage supply node is ground. Embodiments in which the second voltage supply node is a voltage node other than ground are also contemplated herein. The resistive divider circuit including resistive device 241 and resistive device 242 establishes reference voltage VREF as I_BIAS_RTUNE*R2, where R2 is resistive impedance of resistive device 242.

Amplifier circuit 120 is an amplifier circuit that is electrically connected as a unity gain buffer. In some embodiments, amplifier circuit 120 is a two-stage amplifier. Transistor 223 and transistor 224 are a differential pair. A gate electrode of transistor 223 is a non-inverting input terminal of amplifier circuit 120. A gate electrode of transistor 224 is an inverting input terminal of amplifier circuit 120. A source electrode of transistor 223 is electrically coupled with a source electrode of transistor 224. The gate electrode of transistor 223 is electrically coupled with node 26 for receiving reference voltage VREF.

Transistor 221 and transistor 222 are an active load. A drain electrode of transistor 221 is electrically coupled with a drain electrode of transistor 223. A drain electrode of transistor 222 is electrically coupled with a drain electrode of transistor 224. A gate electrode of transistor 221 is electrically coupled with a gate electrode of transistor 222. The gate electrode of transistor 222 is electrically coupled with the drain electrode of transistor 222. Transistor 221, transistor 222, transistor 223, transistor 224 are an amplifier stage.

Transistor 225 is a second amplifier stage of amplifier circuit 120. In some embodiments, transistor 225 is a source follower. A gate electrode of transistor 225 is electrically coupled with node 25. A drain electrode of transistor 225 is an output node of amplifier circuit 120, and is electrically coupled with the gate electrode of transistor 224. As described, amplifier circuit 120 is configured as a unity gain buffer. Output voltage of the unity gain buffer is substantially equal to the input voltage at the non-inverting input terminal of the unity gain buffer. In at least some embodiments, the output voltage of the unity gain buffer tracks the input voltage at the non-inverting input terminal of the unity gain buffer. Amplifier output voltage VOPOUT is substantially equal to reference voltage VREF. In at least some embodiments, the amplifier output voltage VOPOUT tracks reference voltage VREF. Amplifier circuit 120 provides near infinite impedance looking out from node 26, so that operation of amplifier circuit 120 does not change reference voltage VREF. Amplifier circuit 120 is also an active circuit, so amplifier circuit 120 is configured to provide the output voltage under a wide range of current loads.

Voltage buffer 100 and closed-loop current feedback circuit 110 act as a buffer and sensor circuit that outputs output voltage VOUT substantially equal to amplifier output voltage VOPOUT and reference voltage VREF, while further sensing variation in load current I_LOAD drawn by equivalent current source 13. Transistor 201 and transistor 202 are electrically coupled as a current mirror circuit. In some embodiments, transistor 201 and transistor 202 are both N-type metal-oxide-semiconductor (NMOS) transistors. A source electrode of transistor 201 is electrically coupled with the drain electrode of transistor 225 at node 23. A drain electrode of transistor 201 is electrically coupled with a gate electrode of transistor 201 at node 21. A gate electrode of transistor 201 is electrically coupled with a gate electrode of transistor 202. Output voltage VOUT is outputted at a source electrode of transistor 202. Output current I_TAT is total current (I_LOAD+I_BIAS) drawn through transistor 202 and transistor 212.

In some embodiments, transistor 212 and transistor 211 are P-type metal-oxide-semiconductor (PMOS) transistors. Transistor 212 senses I_TAT, and forms a feedback current mirror with transistor 211. A drain electrode of transistor 212 is electrically coupled with the drain electrode of transistor 202. The drain electrode of transistor 212 is also electrically coupled with a gate electrode of transistor 212 at node 22. A gate electrode of transistor 211 is electrically coupled with the gate electrode of transistor 212. A drain electrode of transistor 211 is electrically coupled with the drain electrode and gate electrode of transistor 201 at node 21. In some embodiments, when output current I_TAT increases, output voltage VOUT is temporarily pulled down. Transistor 212 mirrors the increase in output current I_TAT to transistor 211. The increase in current flowing through transistor 211 increases current flowing through transistor 201. The increased current flowing through transistor 201 causes the voltage at node 21 to increase. The increase in the voltage at node 21 pulls up output voltage VOUT.

In addition to closed-loop current feedback circuit 110, load current compensation circuit 150 also provides current compensation to aid in keeping output current I_TAT constant. Variable bias current source 352 of load current compensation circuit 150 provides a bias current that varies with changes in load current I_LOAD drawn by equivalent current source 13.

Figure 3:
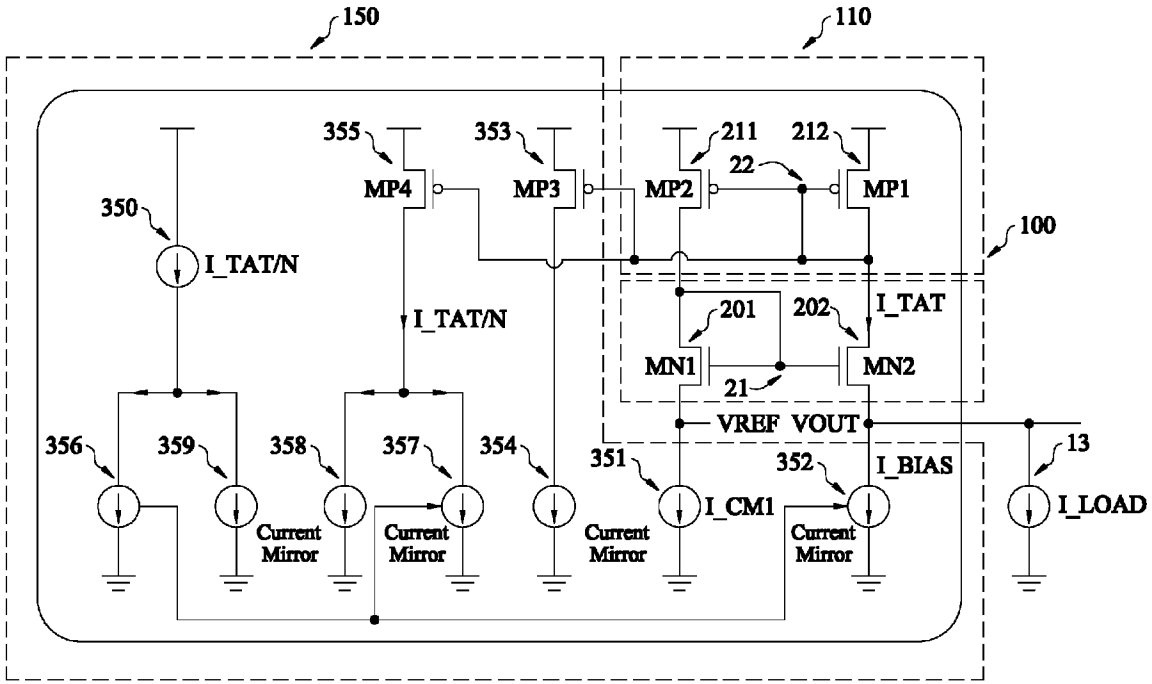
FIG. 3 is a circuit diagram of a load current compensation circuit of a voltage regulator, in accordance with one or more embodiments of the present disclosure.

FIG. 3 is a circuit schematic diagram of load current compensation circuit 150, in accordance with one or more embodiments of the present disclosure. Variable bias current source 352 provides a variable bias current in response to changes in load current I_LOAD drawn by equivalent current source 13. Control of variable bias current source 352 is accomplished by transistor 355, current source 357, current source 358, reference current source 350, current source 359, and current source 356.

Reference current source 350 is a reference current source that establishes I_TAT/N, where N is a positive number typically greater than 1. Through multiplication by N, a target value for output current I_TAT as the sum of load current I_LOAD and bias current I_BIAS is set. In some embodiments, the target value for output current I_TAT is voltage buffer 100 microamperes, N is voltage buffer 100, and I_TAT/N is 1 microampere. In some embodiments, reference current source 350 is a bandgap current source.

I_TAT/N is split into a current drawn by current source 356, and a current drawn by current source 359. The current drawn by current source 359 is proportional to I_LOAD. The current drawn by current source 356 is proportional to I_BIAS. Bias current I_BIAS is variable in response to a control by current source 356. Current source 356 is electrically coupled with reference current source 350 and variable bias current source 352, and current source 359 is electrically coupled with reference current source 350.

Transistor 355, current source 357, and current source 358 feedback changes in load current I_LOAD to current source 359. Transistor 355 forms a current mirror with transistor 212. In some embodiments, transistor 355 is a PMOS transistor. A gate electrode of 335 is electrically coupled with the gate electrode of transistor 212 at node 22. Current conducted by transistor 355 is responsive to changes in the voltage at node 22, and by extension to changes in current conducted by transistor 212, namely output current I_TAT, and further to changes in I_LOAD. For example, an instant change in load current I_LOAD that temporarily increases output current I_TAT lowers the voltage at node 22, and increases the current flowing through transistor 355. The opposite is true for an instant change in load current I_LOAD that temporarily decreases output current I_TAT. Transistor 355 is configured to provide information on electrical current variations in I_LOAD. In some embodiments, the current conducted by transistor 355 is equal to I_TAT/N.

The current conducted by transistor 355 is split between current source 357 and current source 358. The sum of currents drawn by current source 357 and current source 358 is the current flowing through transistor 355. Current source 357 conducts current proportional to bias current I_BIAS, and current source 358 conducts current proportional to load current I_LOAD. Current source 357 forms a current mirror with current source 356. Electrical current flowing through current source 357 is proportional to and tracks electrical current flowing through current source 356. In some embodiments, the current flowing through current source 357 equals the current flowing through current source 356. Current source 357 is electrically coupled with current source 356. Current source 358 is electrically coupled with current source 359. In some embodiments, the current conducted by current source 359 is equal to, and controlled by, the current conducted by current source 358.

Detailed description of operation of reference current source 350, current source 356, current source 359, transistor 355, current source 358, and current source 357 follows. An example is given for illustrative purposes.

Assuming load current I_LOAD increases, to maintain fixed output current I_TAT, bias current I_BIAS should be reduced. When load current I_LOAD increases, output current I_TAT increases temporarily, which causes I_TAT/N generated by transistor 355 to increase temporarily. Because current flowing through current source 357 is controlled by current source 356, and current source 356 is unaffected by the increase in I_TAT/N at transistor 355, the current increase is transferred completely to current source 358. When the current flowing through current source 358 increases temporarily due to the increase in load current I_LOAD as just described, the current flowing through current source 359 increases due to the current mirror relationship between current source 359 and current source 358. Because the current flowing through current source 359 is increased, and I_TAT/N conducted by reference current source 350 is a fixed value, the current flowing through current source 356 decreases. As a result of the mirror relationship between current source 356 and variable bias current source 352, the decrease in the current flowing through current source 356 causes a proportional decrease in bias current I_BIAS conducted by variable bias current source 352. Output current I_TAT is then restored to the target value by the lower bias current I_BIAS responsive to the higher I_LOAD. The current flowing through current source 357 is also lowered in response to the decrease in the current flowing through current source 356, which restores I_TAT/N conducted by transistor 355 to its original value prior to the temporary increase caused by the increase in I_LOAD. In the case of decreasing I_LOAD, the opposite effect occurs.

In some embodiments, load current compensation circuit 150 further includes transistor 353, current source 354, and current source 351. Transistor 353, current source 354, and current source 351 maintain current conducted by transistor 201 and transistor 211 at a predetermined value by a similar feedback mechanism to that just described. Current source 351 is a variable current source that is controlled by a current mirror relationship with current source 354. Increases in current conducted by current source 354 result in proportionate increases in mirror current I_CM1 conducted by current source 351. Decreases in the current conducted by current source 354 result in proportionate decreases in mirror current I_CM1. Continuing the above example of an increase in I_LOAD, output current I_TAT increases temporarily. A current mirror relationship between transistor 353 and transistor 212 causes a temporary increase in current supplied by transistor 353. The increase in the current supplied by transistor 353 increases the current conducted by current source 354. The increase in the current conducted by current source 354 causes an increase in mirror current I_CM1. Experimental results have shown that inclusion of transistor 353, current source 354, current source 351 allows designers to select a lower-performance specification for amplifier circuit 120 while maintaining performance of electronic circuit 10.

Figure 4:
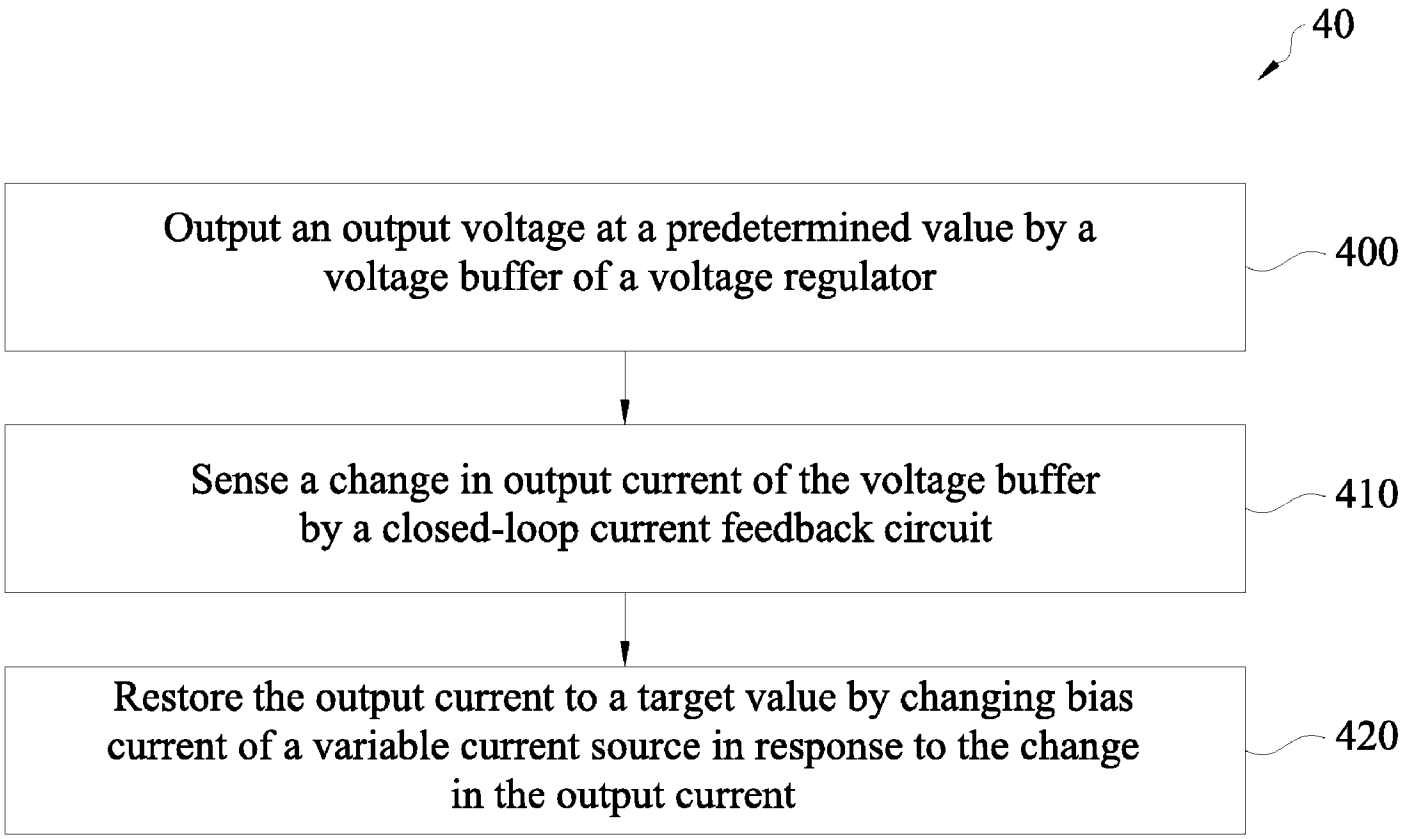
FIG. 4 is a flowchart of a method of operating a voltage regulator, in accordance with one or more embodiments of the present disclosure.

FIG. 4 is a flowchart of a method 40 of operating electronic circuit 10, in accordance with one or more embodiments of the present disclosure. Description of the method 40 in terms of electronic circuit 10 should not, however, be considered limiting on the method 40. Embodiments of the method 40 as applied to other voltage regulator configurations should also be considered within the scope of the disclosure.

Voltage buffer 100 outputs output voltage VOUT at a predetermined value in operation 400. In some embodiments, the predetermined value is set by resistive divider 140 as reference voltage VREF. In some embodiments, the method 40 further includes buffering reference voltage VREF by at least voltage buffer 100. In some embodiments, the method 40 further includes buffering reference voltage VREF by amplifier circuit 120. Closed-loop current feedback circuit 110 further provides closed-loop current feedback in operation of voltage buffer 100.

A change in output current I_TAT is sensed by closed-loop current feedback circuit 110 in operation 410. When output current I_TAT increases, the voltage at node 22 decreases. When output current I_TAT decreases, the voltage at node 22 increases. In some embodiments, the change in output current I_TAT is due to a change in load current I_LOAD.

Output current I_TAT conducted by voltage buffer 100 is restored to the target value by changing bias current I_BIAS of load current compensation circuit 150 in response to the change in output current I_TAT in operation 420. Bias current I_BIAS is changed by mirroring the current of current source 356 in variable bias current source 352. The current of current source 356 is changed through operation of transistor 355, current source 357, current source 358, current source 359, and reference current source 350. Current feedback is performed by mirroring output current I_TAT from transistor 212 to transistor 355, mirroring the current of current source 358 to current source 359, and mirroring the current of current source 356 to variable bias current source 352.

The discussed embodiments achieve at least one of the following advantages. Electronic circuit 10 is an open-loop design, which provides a speed advantage over closed-loop approaches. Load current compensation circuit 150 allows for a wide range of output capacitor/current load, while also minimizing ground level dynamic range. Fixed output current I_TAT at the output of electronic circuit 10 minimizes voltage damping and improves output voltage accuracy.

In accordance with one or more embodiments of the present disclosure, a device comprises a voltage buffer, a load compensation circuit, and a closed-loop current feedback circuit. The voltage buffer is configured to output an output voltage and an output current. The output current is the sum of a load current and a bias current. The load compensation circuit is configured to output the bias current at a variable level based on a variation in the load current. The closed-loop current feedback circuit is configured to feedback a voltage level based on the variation to the load compensation circuit.

In accordance with one or more embodiments of the present disclosure, a device comprises a resistive divider, an amplifier circuit, a voltage buffer, a closed-loop current feedback circuit, and a load current compensation circuit. The resistive divider is configured to output a reference voltage. The amplifier circuit is configured to output a first voltage equal to the reference voltage. The voltage buffer is configured to output an output voltage equal to the first voltage. The closed-loop current feedback circuit is configured to output a second voltage based on an output current of the voltage buffer. The load current compensation circuit is configured to vary the output current and a second current of the voltage buffer based on the second voltage.

In accordance with one or more embodiments of the present disclosure, a method comprises outputting an output voltage at a predetermined value using a voltage buffer of a voltage regulator; sensing a change in output current of the voltage buffer using a closed-loop current feedback circuit; and restoring the output current to a target value by changing a bias current of a variable current source in response to the change in the output current.

As used in this application, "or" is intended to mean an inclusive "or" rather than an exclusive "or". In addition, "a" and "an" as used in this application are generally be construed to mean "one or more" unless specified otherwise or clear from context to be directed to a singular form. Also, at least one of A and B and/or the like generally means A or B or both A and B. Furthermore, to the extent that "includes", "having", "has", "with", or variants thereof are used in either the detailed description or the claims, such terms are intended to be inclusive in a manner similar to the term "comprising". Moreover, the term "between" as used in this application is generally inclusive (e.g., "between A and B" includes inner edges of A and B).

Although the present embodiments and their advantages have been described in detail, it should be understood that one or more changes, substitutions, and alterations can be made herein without departing from the spirit and scope of the disclosure as defined by the appended claims. Moreover, the scope of the present application is not intended to be limited to the particular embodiments of the process, machine, manufacture, composition of matter, means, methods, and steps described in the specification. As one of ordinary skill in the art will readily appreciate from the disclosure, processes, machines, manufacture, compositions of matter, means, methods, or steps, presently existing or later to be developed, that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A device comprising:

a voltage buffer comprising first and second transistors and being configured to output an output voltage and an output current, the output current being a sum of a load current and a bias current;

a load compensation circuit configured to output the bias current at a variable level based on a variation in the load current; and a closed-loop current feedback circuit comprising a current mirror including a third transistor and a fourth transistor and configured to mirror the output current, the closed-loop current feedback circuit configured to feedback a voltage level based on the variation to the load compensation circuit, wherein the first transistor of the voltage buffer comprises a drain electrode coupled with a gate electrode of the first transistor.

2. The device of claim 1, wherein the load compensation circuit comprises:

a reference current source configured to provide a reference current proportional to the output current;

a feedback current source configured to mirror the output current including the variation;

a current mirror configured to feedback a first current proportional to the load current;

a current source configured to output a second current equal to a difference between the reference current and the first current; and a bias current source configured to output the bias current proportional to the second current by mirroring the second current.

3. The device of claim 1, wherein the voltage buffer comprises:

the first transistor comprising:

a source electrode coupled with a reference voltage node; and the second transistor comprising:

a source electrode coupled with the load compensation circuit; and a gate electrode coupled with the gate electrode of the first transistor.

4. The device of claim 3, wherein the closed-loop current feedback circuit comprises:

the third transistor comprising:

a drain electrode coupled with a drain electrode of the second transistor; and a gate electrode electrically coupled with the drain electrode of the third transistor; and the fourth transistor comprising:

a drain electrode coupled with the gate electrode of the first transistor; and a gate electrode coupled with the gate electrode of the third transistor.

5. The device of claim 1, further comprising:

a resistive divider configured to output a reference voltage equal to the output voltage; and an amplifier circuit configured to output a voltage equal to the reference voltage to the voltage buffer.

6. The device of claim 5, wherein the amplifier circuit is electrically connected as a unity gain buffer.

7. A device comprising:

a resistive divider configured to output a reference voltage;

an amplifier circuit configured to output a first voltage equal to the reference voltage;

a voltage buffer comprising first and second transistors and being configured to output an output voltage equal to the first voltage;

a closed-loop current feedback circuit comprising a current mirror including a third and a fourth transistor and configured to output a second voltage based on an output current of the voltage buffer; and a load current compensation circuit configured to vary the output current and a second current of the voltage buffer based on the second voltage, wherein the first transistor of the voltage buffer comprises a drain electrode coupled with a gate electrode of the first transistor.

8. The device of claim 7, wherein the voltage buffer comprises:

the first transistor comprising:

a source electrode coupled with an output terminal of the amplifier circuit; and the second transistor comprising:

a source electrode coupled with the load compensation circuit; and a gate electrode electrically coupled with the gate electrode of the first transistor; and the load current compensation circuit comprises:

a current mirror configured to output the second current to the first transistor based on the second voltage.

9. The device of claim 8, wherein the closed-loop current feedback circuit comprises:

the third transistor comprising a drain electrode coupled with a drain electrode of the second transistor; and a gate electrode coupled with the drain electrode of the third transistor; and the fourth transistor having:

a drain electrode coupled with the gate electrode of the first transistor; and a gate electrode coupled with the gate electrode of the third transistor.

10. The device of claim 7, wherein the load compensation circuit comprises:

a reference current source configured to provide a reference current proportional to the output current;

a transistor configured to mirror the output current;

a first current source configured to draw a first current from the reference current source, the first current being proportional to a load current component of the output current;

a second current source configured to draw a second current from the reference current source, the second current being equal to a difference between the reference current and the first current;

a third current source configured to draw a third current from the transistor, the third current being proportional to the load current component;

a fourth current source configured to draw a fourth current from the transistor, the fourth current being mirrored from the second current source; and a bias current source configured to vary the output current by outputting the bias current by mirroring the second current.

11. The device of claim 10, wherein the load compensation circuit further comprises:

a second transistor configured to mirror the output current;

a fifth current source configured to draw a fifth current from the second transistor, the fifth current being proportional to the output current; and a sixth current source configured to mirror the fifth current to draw a sixth current at an output node of the amplifier circuit.

12. The device of claim 7, further comprising:

a bias circuit configured to supply a first bias current to the resistive divider, and to supply a second bias current to the amplifier circuit.

13. A method comprising:

outputting an output voltage at a predetermined value using a voltage buffer of a voltage regulator, the voltage buffer comprising first and second transistors, the first transistor having a drain electrode coupled with a gate electrode of the first transistor;

sensing a change in output current of the voltage buffer using a current mirror of a closed-loop current feedback circuit to mirror the output current; the current mirror including at least two transistor different from the first and the second transistors of the voltage buffer; and restoring the output current to a target value by changing a bias current of a variable current source in response to the change in the output current.

14. The method of claim 13, wherein restoring the output current further comprises:

mirroring the output current using a third transistor to generate a first mirrored current;

drawing a first current proportional to the bias current from the third transistor;

drawing a second current as a difference between the first mirrored current and the first current;

generating a reference current by a reference current source;

drawing a third current equal to the second current from the reference current source;

drawing a fourth current as a difference between the reference current and the third current; and changing the bias current by mirroring the fourth current.

15. The method of claim 14, further comprising:

mirroring the output current using a fourth transistor to generate a second mirrored current;

drawing a fifth current from the fourth transistor equal to the second mirrored current; and varying input voltage of the voltage buffer by mirroring the fifth current to an input terminal of the voltage buffer.

16. The method of claim 13, wherein sensing the change further comprises:

sensing a change in load current drawn from the voltage buffer using a load circuit coupled with the voltage buffer.

17. The method of claim 13, further comprising:

generating a reference voltage using a bias circuit and a resistive divider; and outputting a first voltage to the voltage buffer using an amplifier circuit based on the reference voltage.

18. The method of claim 17, wherein outputting the first voltage further comprises:

buffering the first voltage using a unity gain buffer including the amplifier circuit.

19. The method of claim 13, wherein sensing the change further comprises:

conducting the output current through a third transistor; and outputting a first voltage at a gate electrode of the third transistor based on a magnitude of the output current.

20. The method of claim 19, wherein restoring the output current further comprises:

restoring the output current to the target value by changing the bias current of the variable current source based on the first voltage.

* * * * *